US007404502B2

(12) United States Patent
Ho et al.

(10) Patent No.: US 7,404,502 B2
(45) Date of Patent: Jul. 29, 2008

(54) HANGER ASSEMBLY AND A HANGER FORMED OF SUCH AN ASSEMBLY

(75) Inventors: Leung Ho, Beacon Hill (CN); Alex Hin Ho, Beacon Hill (CN)

(73) Assignee: The Build-Up Plastics & Metal Co., Ltd., Kwun Tong, Kowloon (HK)

( * ) Notice: Subject to any disclaimer, the term of this patent is extended or adjusted under 35 U.S.C. 154(b) by 269 days.

(21) Appl. No.: 10/771,343

(22) Filed: Feb. 5, 2004

(65) Prior Publication Data

US 2005/0184108 A1 Aug. 25, 2005

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | | |
|---|---|---|---|---|---|
| 4,046,293 | A | | 9/1977 | Garrison | |
| 4,416,401 | A | | 11/1983 | King | |
| 4,653,678 | A | | 3/1987 | Blanchard et al. | |
| 4,730,737 | A | * | 3/1988 | Robinson | 211/113 |
| 4,871,098 | A | | 10/1989 | Bredeweg et al. | |
| 4,884,727 | A | * | 12/1989 | Blanchard | 223/93 |
| 5,577,644 | A | * | 11/1996 | Chen | 223/85 |
| 5,680,972 | A | * | 10/1997 | Clarke | 223/88 |
| D394,753 | S | | 6/1998 | Zuckerman | |
| 5,803,321 | A | | 9/1998 | Willinger et al. | |
| 5,810,216 | A | * | 9/1998 | Leopold | 223/85 |
| 6,070,772 | A | | 6/2000 | Bond | |
| 6,105,834 | A | * | 8/2000 | Cohen | 223/88 |
| 6,308,872 | B1 | * | 10/2001 | Duerr et al. | 223/88 |
| 6,467,658 | B1 | * | 10/2002 | Olk et al. | 223/88 |
| D471,724 | S | | 3/2003 | Bodine | |
| D471,725 | S | | 3/2003 | Bodine | |
| D472,393 | S | | 4/2003 | Louw | |
| D480,566 | S | | 10/2003 | Neathery | |
| 6,688,502 | B2 | | 2/2004 | Kunreuther | |
| 6,758,378 | B2 | | 7/2004 | Carmichael | |
| 6,758,379 | B1 | * | 7/2004 | Elwell | 223/85 |
| 6,875,392 | B2 | | 4/2005 | Olk et al. | |

* cited by examiner

*Primary Examiner*—Shaun R Hurley
(74) *Attorney, Agent, or Firm*—Hoffmann & Baron, LLP

(57) ABSTRACT

A hanger assembly is disclosed as including a main body with a male portion, a hook joined at an upper portion of the body, and a hook receiving element adapted to engage with the male portion. A hanger is also disclosed as being formed of engagement of the body and the hook receiving element of the hanger assembly. There is also disclosed a method of forming a hanger, including the steps of (a) providing a main body with a male portion; (b) providing a hook at an upper portion of the body; (c) providing a hook receiving element adapted to engage with the male portion; and (d) engaging the male portion with the hook receiving element to thereby engage the body with the hook receiving element.

29 Claims, 4 Drawing Sheets

HANGER ASSEMBLY AND A HANGER FORMED OF SUCH AN ASSEMBLY

This invention relates to a hanger assembly, in particular a hanger assembly for supporting garments. The present invention also relates to a method of forming a hanger from such a hanger assembly.

BACKGROUND OF THE INVENTION

There are in existence a number of ganging hangers, which allow a hanger to be supported by and suspended from another hanger.

For example, U.S. Pat. No. 4,871,098 issued to Bredeweg et al. discloses a garment hanger with a hook and a dependent loop vertically aligned with the hook. The legs forming the legs are joined at their lower ends and are offset from each other in a normal to the face of the hanger whereby the hook of a second hanger can be passed through the loop and support the second hanger while confined between and parallel to the front and back faces of the hanger body supporting it.

U.S. Pat. No. 5,803,321 issued to Willinger et al. discloses a garment hanger having a hanger body, a hook member, and a hook receiving element for suspending from the garment hanger a second garment hanger. The hook receiving element is disposed in vertical alignment with the hook member and includes a frame member and base member, the frame member being provided with openings to define first and second intersecting passageways for selectively receiving the hanging means of the second garment hanger. The second garment hanger may thus be suspended in a plane parallel to the plane of the hanger body or perpendicular thereto.

U.S. Design Pat. No. 394,753 issued to Zuckerman discloses a design for a ganging assembly of ganging hanger.

U.S. Pat. No. 6,467,658 issued to Olk et al. discloses a coordinate loop garment comprising a molded plastic hanger body having a hook receiving element depending from and molded integrally with the molded plastic body at a lower portion thereof. The hook receiving loop element includes a passageway for selectively receiving and suspending therefrom a hook of a second ganged garment hanger which is at least partially enclosed along its length by the left, right, top and bottom surfaces.

In these prior art garment hangers, the hook receiving element is formed integrally with the body of the hanger, with the following shortcomings:

1. As the body of the hanger is intended to support a garment, which may be rather heavy, the material with which the body is made should be of a high rigidity. On the other hand, the hook receiving element should be of less rigidity so as to give some yield, and thus to prevent breakage, when the hook of a second hanger clashes with it when it is attempted to suspend the second hanger from the original hanger. This difference in rigidity cannot be provided for in the prior art garment hangers, as such existing garment hangers are molded integrally of a single material.
2. As the garment hangers are made of a single material, even if they are of different sizes, they are all of the colour and general outlook. It is very difficult for a user, or even the manufacturer, to differentiate between garments of different sizes.

It is thus an object of the present invention to provide a hanger assembly, a hanger formed of such a hanger assembly, and a method of forming such a hanger, in which the aforesaid shortcomings are mitigated, or at least to provide a useful alternative to the public.

It is a further object of the present invention to provide a hanger in which the body and the hook receiving element are made of different materials, each of a different rigidity.

It is a yet further object of the present invention to provide a hanger in which the body and the hook receiving element are of different colours, so as to allow visual differentiation of sizes and other characteristics.

Such and other objects of the present invention will become apparent from the ensuing discussion.

SUMMARY OF THE INVENTION

According to a first aspect of the present invention, there is provided a hanger assembly including a body member with a first engagement member; a hook member joined at an upper portion of said body member; and a hook receiving member with a second engagement member adapted to engage with said first engagement member.

According to a second aspect of the present invention, there is provided a hanger formed of engagement of a body member and a hook receiving member of a hanger assembly, said hanger assembly including a body member with a first engagement member, a hook member joined at an upper portion of said body member, and a hook receiving member with a second engagement member adapted to engage with said first engagement member.

According to a third aspect of the present invention, there is provided a method of forming a hanger, including the steps of (a) providing a body member with a first engagement member; (b) providing a hook member at an upper portion of said body member; (c) providing a hook receiving member with a second engagement member adapted to engage with said first engagement member; and (d) engaging said first and second engagement members to thereby engage said body member with said hook receiving member.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1:
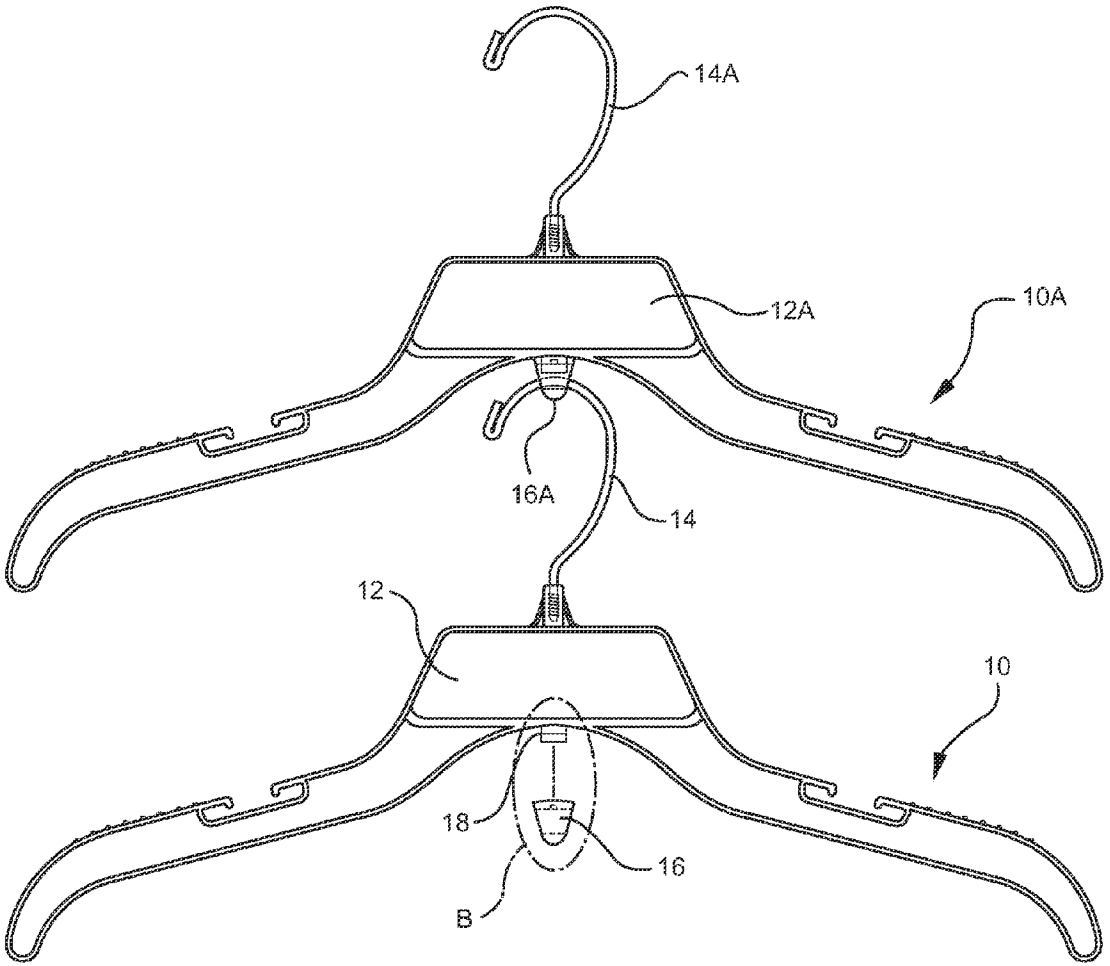
FIG. 1 shows two hangers according to the present invention engaged with each other.

Two hangers, generally designated as 10 and 10A respectively, according to the present invention are shown in FIG. 1 as one being suspended from the other. The hanger 10A has a main body 12A, to an upper part of which is joined a hook 14A. Engaged with the lower part of the main body 12A is a hook receiving element 16A. Similarly, the hanger 10 includes a main body 12, to an upper part of which is joined a hook 14.

Shown as being separate from the main body 12 of the hanger 10 is a hook receiving element 16, which is adapted to be engaged with a male portion 18 extending from a lower part of the main body 12 of the hanger 10, in a manner and for a purpose to be further discussed below. It can also be seen in FIG. 1 that the hook 14 of the hanger 10 is received within a passageway (to be further discussed below) of the hook receiving element 16A of the hanger 10A, for suspending the hanger 10 from the hanger 10A.

Figure 2:
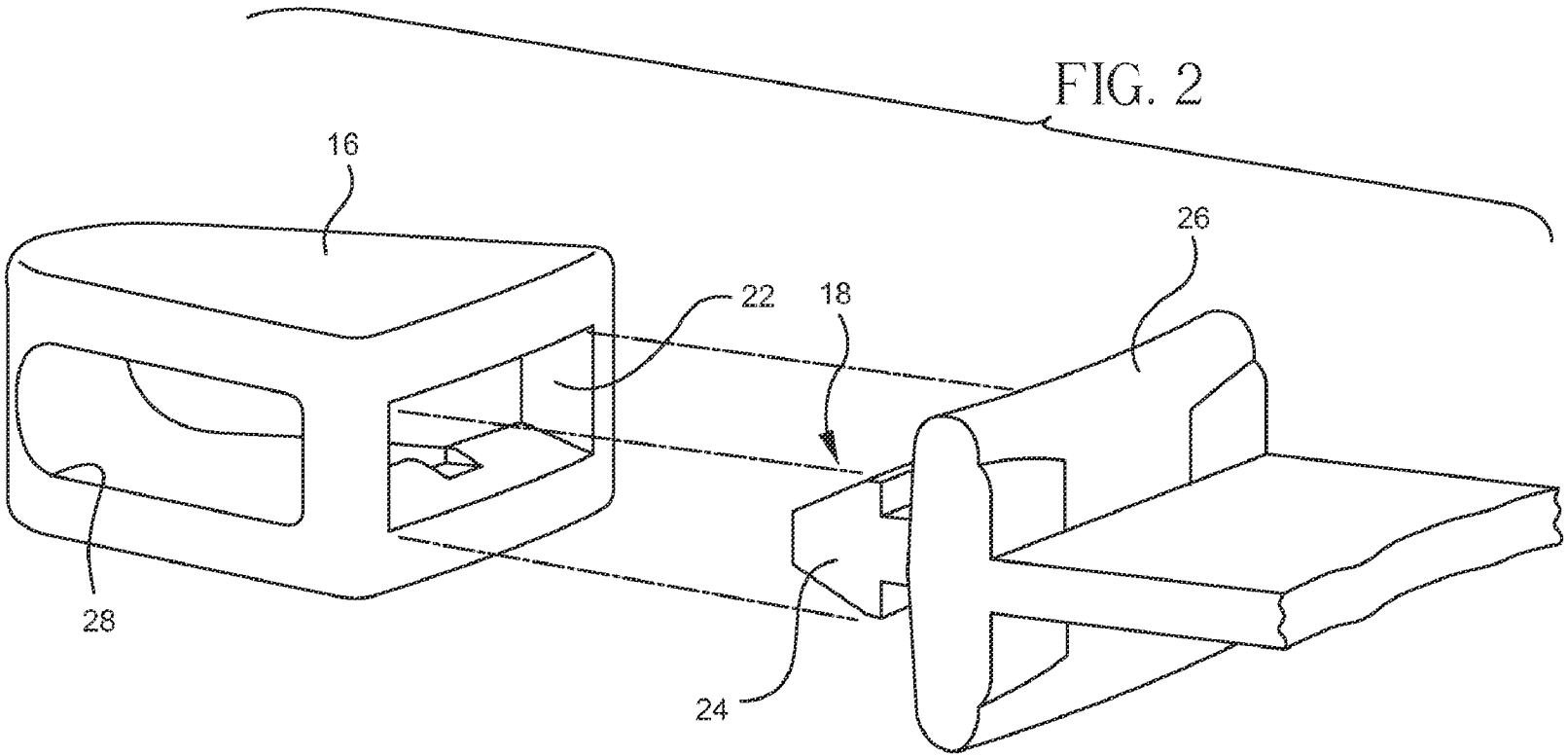
FIG. 2 is an enlarged perspective view of the part marked B shown in FIG. 1.

As shown in FIG. 2, the hook receiving element 16 has a generally rectangular aperture 22, allowing insertion of a tongue 24 of the male portion 18. The male portion 18 has a generally rectangular stopper 26 for limiting the extent to which the tongue 24 may extend into the interior of the hook receiving element 16. When the tongue 24 is received into the hook receiving element 16, they snap-fit with each other, so that they cannot be separated from each other without breaking either the male portion 18 or the hook receiving element 16. The hook receiving element 16 also has a passageway 28 through which a hook of another hanger may pass through. A hanger may thus be formed by engaging the male portion 18 of the body 12 with the hook receiving element 16.

Figure 3B:
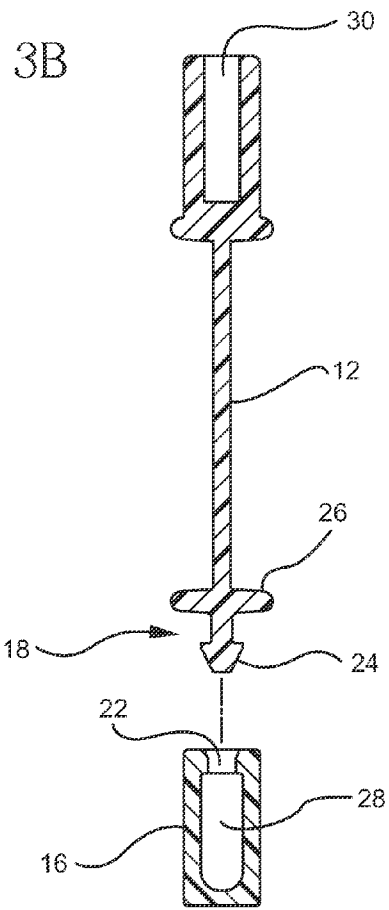
FIG. 3B is a cross-sectional view taken along the line A-A in FIG. 3A.
Figure 3A:
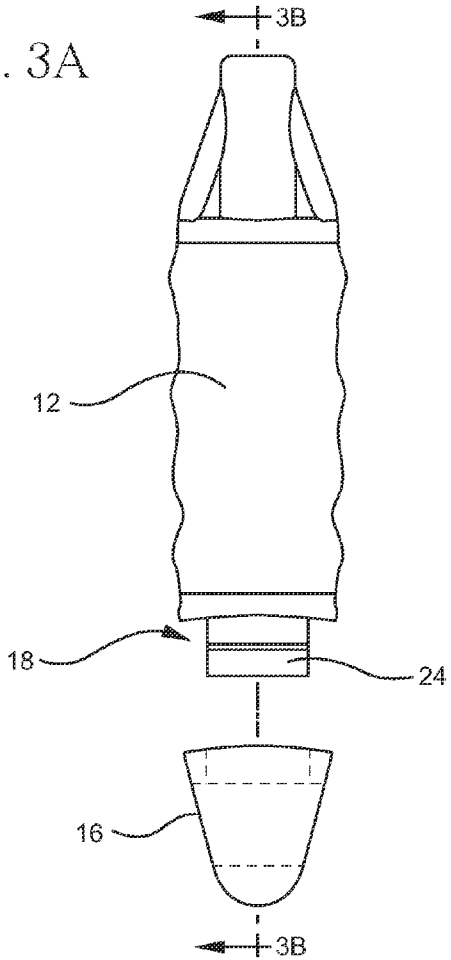
FIG. 3A is an enlarged front view of part of the body of the hanger and the hook receiving element shown in FIG. 1.
Figure 4B:
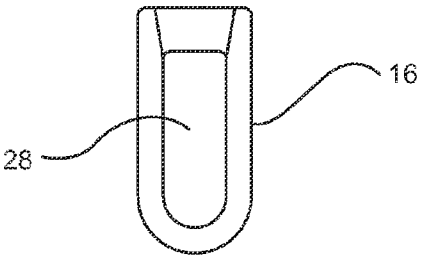
FIG. 4B is a side view of the hook receiving element shown in FIG. 4A.
Figure 4C:
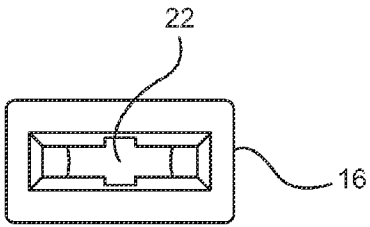
FIG. 4C is a top view of the hook receiving element shown in FIG. 4A.
Figure 4A:
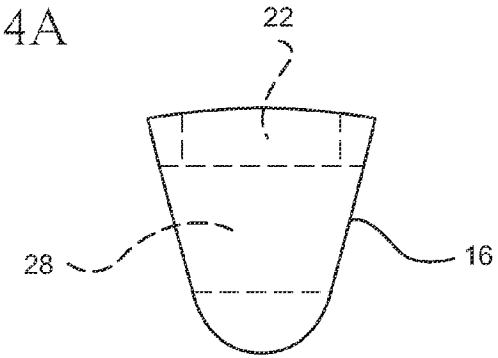
FIG. 4A is a front view of the hook receiving element shown in FIG. 1.

FIGS. 3A and 3B show in more detail the shape and configuration of the male portion 18 and the hook receiving element 16 of the hanger 10. It can also be seen that at the upper end of the body 12 is a generally cylindrical recess 30 for receiving and engagement with the hook 14. As to FIGS. 4A to 4C, such show various views of the hook receiving element 16.

Whereas the hook receiving element 16 is made of polyethylene, the body 12 is made of polystyrene, which is more rigid than polyethylene. By way of such an arrangement, while the body 12 is of sufficient rigidity to support various garments, the hook receiving element 16 can give some yield, and thus to prevent breakage, when the hook of a second hanger clashes with it when it is attempted to suspend the second hanger from the hanger 10.

It is also possible to form the body 12 and the hook receiving element 16 in different colours. For example, the body 12 may be transparent or black, whereas the hook receiving element 16 may be red, blue, or green, each signifying a different size, e.g. small, medium or large. This would allow for easy identification of the size of the hangers 10.

Additionally, it is possible to provide a hanger assembly with a hanger 10 and a plurality of hook receiving elements 16, e.g. each with the same size of aperture 22, but with a different overall size, so that the same hanger 10 may be fitted with a different hook receiving element for suspending a second hanger with a different size of hook 14.

The manufacturer may provide the finished products to the customers in either assembled or dissembled state, according to the wish of the customers. The customers are given more flexibility in that the they can decide whether to provide the hanger 10 with the hook receiving element 16 after delivery of the products. Such will also reduce the molding cost, as the manufacturer only has to have two mold sets, one for the main body 12 and one for the hook receiving element 16, which is relatively small. Otherwise, as in the prior art situation, the manufacturer will still have to provide two mold sets, one for a hanger with a hook receiving element, and one for a hanger with no receiving element.

It should be understood that the above only illustrates an example whereby the present invention may be carried out, and that various modifications and/or alterations may be made thereto without departing from the spirit of the invention. It should also be understood that various features of the invention which are, for brevity, described here in the context of a single embodiment, may be provided separately or in any appropriate sub-combinations.

What is claimed is:

1. A hanger assembly including:

a body member having a generally I-beam construction defining a flange extending around the perimeter thereof, said body member having a central body portion and a pair of downwardly-sloping arms extending from opposite sides thereof, said arms adapted to support at least one garment item;

a hook member joined to an upper part of said central body portion;

a first snap-fit engagement member centrally located on a lower part of said central body portion and extending downward from said flange; and a hook receiving member having a second snap-fit engagement member adapted to engage with said first snap-fit engagement member.

2. A hanger assembly according to claim 1 wherein at least part of said first snap-fit engagement member is adapted to be inserted into said second snap-fit engagement member for engagement therewith.

3. A hanger assembly according to claim 1 wherein said body member and said hook receiving member are made at least principally of different materials.

4. A hanger assembly according to claim 3 wherein said body member is made at least principally of polystyrene.

5. A hanger assembly according to claim 3 wherein said hook receiving member is made at least principally of polyethylene.

6. A hanger assembly according to claim 1 wherein said body member and said hook receiving member are of different rigidity.

7. A hanger assembly according to claim 1 wherein said body member and said hook receiving member are of different colours.

8. A hanger assembly according to claim 1 comprising a plurality of said hook receiving members.

9. A hanger assembly according to claim 8 wherein at least two of said hook receiving members are of different sizes.

10. A method of forming a hanger, including the steps of:

(a) providing a body member having a generally I-beam construction defining a flange extending around the perimeter thereof, said body member having a central body portion and pair of downwardly-sloping arms extending from opposite sides thereof, said arms adapted to support at least one garment item;

(b) providing a hook member at an upper part of said central body portion;

(c) providing a first snap-fit engagement member in a central location on a lower part of said central body portion so that the first snap-fit member extends downward from said flange;

(d) providing a hook receiving member having a second snap-fit engagement member adapted to engage with said first snap-fit engagement member; and (e) engaging said first and second snap-fit engagement members to thereby engage said body member with said hook receiving member.

11. A method according to claim 10 wherein said step (e) further comprises the step of inserting at least part of said first snap-fit engagement member into said second snap-fit engagement member.

12. A method according to claim 10 wherein said body member and said hook receiving member are made at least principally of different materials.

13. A method according to claim 12 wherein said body member is made at least principally of polystyrene.

14. A method according to claim 12 wherein said hook receiving member is made at least principally of polyethylene.

15. A method according to claim 10 wherein said body member and said hook receiving member are of different rigidity.

16. A method according to claim 10 wherein said body member and said hook receiving member are of different colours.

17. A hanger assembly according to claim 1 wherein said first and second snap-fit engagement members engage one another in a non-removable manner.

18. A method according to claim 10 wherein said first and second snap-fit engagement members engage one another in a non-removable manner.

19. A hanger, comprising:

a body member having a generally I-beam construction defining a flange extending around the perimeter thereof, said body member having a central body portion and pair of downwardly-sloping arms extending from opposite sides thereof, said arms adapted to support at least one garment item;

a hook member joined to an upper part of said central body portion; and a first snap-fit engagement member centrally located on a lower part of said central body portion and extending downward from said flange wherein said first snap-fit engagement member includes at least one male engagement portion.

20. A hanger according to claim 19 wherein said male engagement portion includes a generally arrow-shaped tongue.

21. A hanger according to claim 19 wherein said body member and said first snap-fit engagement member are formed of plastic.

22. A hanger according to claim 21 wherein said body member and said first snap-fit engagement member are formed of polystyrene.

23. A hanger assembly, comprising:

a body member having a generally I-beam construction defining a flange extending around the perimeter thereof having a central body portion and pair of downwardly-sloping arms extending from opposite sides thereof, said arms adapted to support at least one garment item;

a hook member joined to an upper part of said central body portion;

a first snap-fit engagement member centrally located on a lower part of said central body portion and extending downward from said flange; and a suspending member having a second snap-fit engagement member adapted to engage with said first snap-fit engagement member.

24. The hanger assembly according to claim 23 wherein said first snap-fit engagement member includes a male engagement portion and wherein said second snap-fit engagement member includes a female engagement portion.

25. A hanger assembly according to claim 24 wherein said first and second snap-fit engagement members engage one another in a non-removable manner.

26. A hanger assembly according to claim 25 wherein said body member and said first snap-fit engagement member are formed of plastic.

27. A hanger assembly according to claim 26 wherein said body member and said first snap-fit engagement member are formed of polystyrene.

28. The hanger assembly according to claim 2 wherein said first snap-fit engagement member includes a male engagement portion and wherein said second snap-fit engagement member includes a female engagement portion.

29. A hanger according to claim 24 wherein said male engagement portion includes a generally arrow-shaped tongue.

* * * * *